United States Patent [19]

Frizzell

[11] Patent Number: 4,507,053

[45] Date of Patent: Mar. 26, 1985

[54] PUMP OFF CONTROL

[76] Inventor: Marvin L. Frizzell, P.O. Box 666, Bangs, Tex. 76823

[21] Appl. No.: 388,651

[22] Filed: Jun. 15, 1982

[51] Int. Cl.[3] ..... F04B 49/02; F04B 49/06

[52] U.S. Cl. ..... 417/12; 417/43

[58] Field of Search ..... 417/12, 43

[56] References Cited

U.S. PATENT DOCUMENTS

| | | | |
|---|---|---|---|
| 3,072,059 | 1/1963 | Heffel | 417/43 |
| 3,299,817 | 1/1967 | Walters et al. | 417/12 |
| 3,559,731 | 2/1971 | Stafford | 417/12 |
| 3,854,846 | 12/1974 | Douglas | 417/43 |
| 3,972,648 | 8/1976 | Sangster | 417/12 |
| 4,179,292 | 12/1979 | Tateshita | 417/12 |
| 4,387,850 | 1/1983 | Gerber | 417/12 |
| 4,413,676 | 11/1983 | Kerwin | 417/12 |

*Primary Examiner*—William L. Freeh

*Attorney, Agent, or Firm*—Marcus L. Bates

[57] ABSTRACT

A pump off control apparatus for a pump assembly located downhole in a wellbore. The control apparatus prevents the pump motor from running for a finite time interval whenever a pump off condition is encountered. When the apparatus is energized, the downhole pump motor is started, and production normally occurs within a short interval of time, otherwise the pump is automatically shut down for a long time interval, and then another attempt is made to produce the well. When proper flow conditions are achieved within the predetermined short time interval, the control continues to monitor the flow and maintain the downhole pump energized until the well is pumped down and a pump off condition is encountered. The pump off condition is sensed by a flow switch interposed in the production line which senses a condition of inadequate flow and causes the circuitry to shut down the production pump for the long time interval.

10 Claims, 3 Drawing Figures

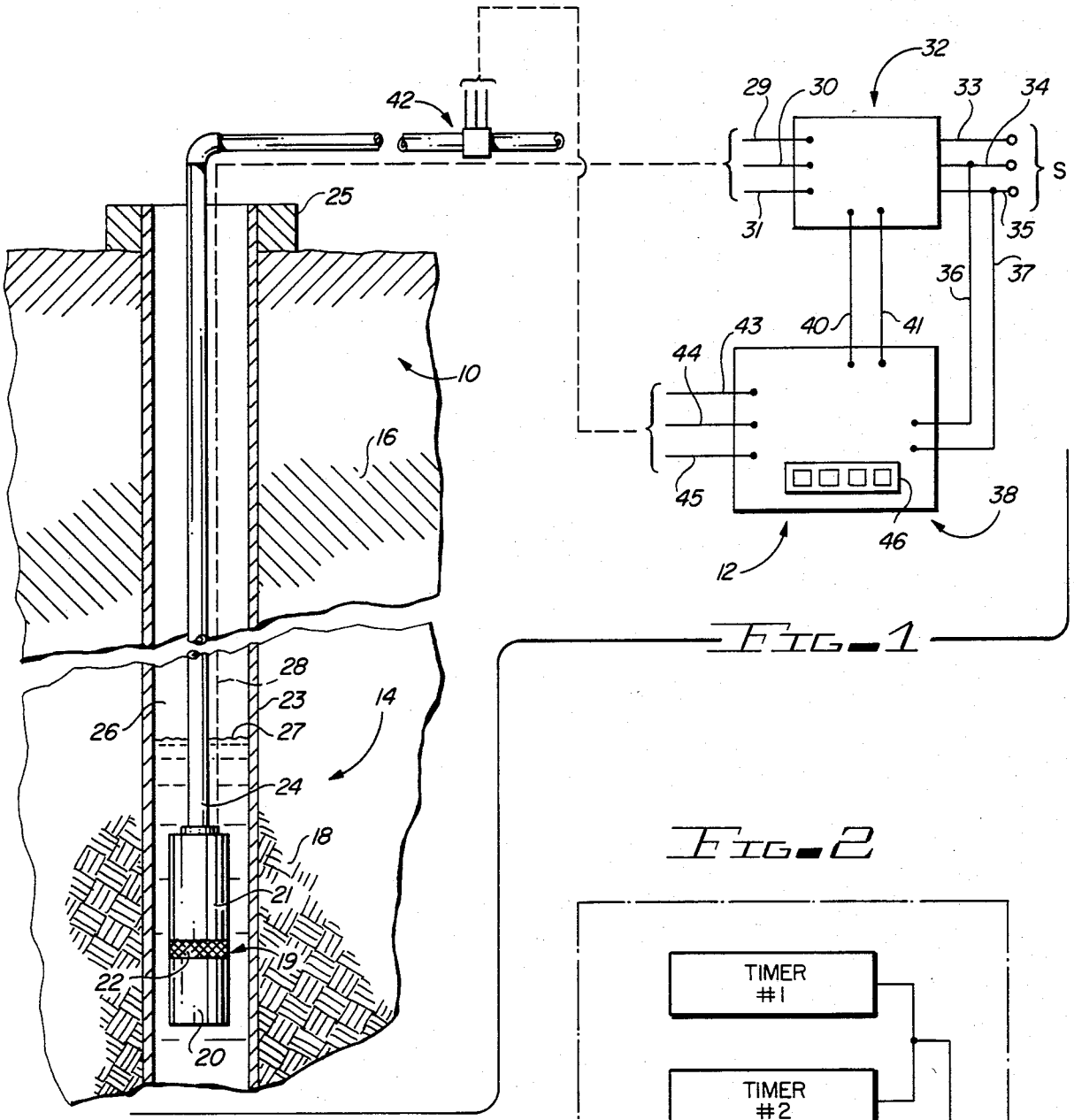
FIG-1
FIG-2
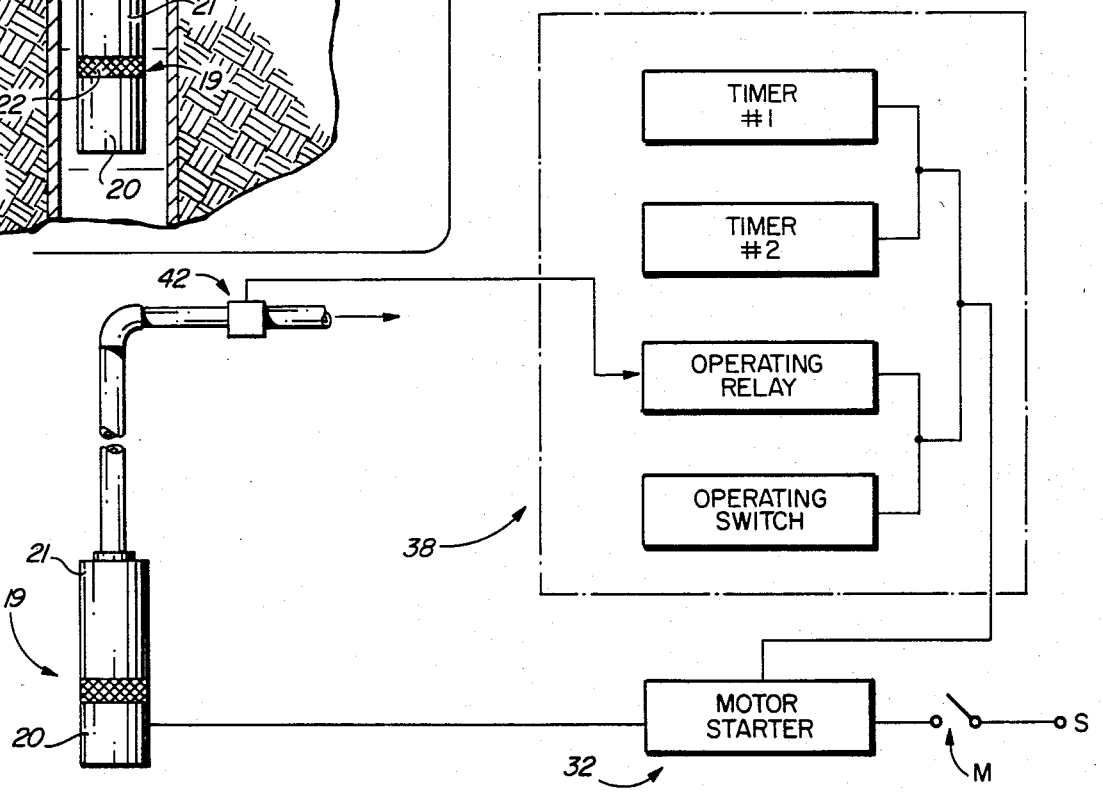

PUMP OFF CONTROL

BACKGROUND OF THE INVENTION

The Submersible pump is one of several available downhole pumps, and provides a magnificent means by which fluid in a shallow well is lifted from a fluid producing strata uphole to the surface of the ground. The submersible pump will last for years if the pump is not abused. One reason this pump is preferred over a sucker rod actuated pump is because it is easily suspended on the bottom of a tubing string, and electrical wires interconnect the pump with a motor starter located at the surface of the earth, so there is hardly any maintenance required with this type pump.

In order to realize maximum efficiency in the production of liquids, whether the liquids be oil or water, it is necessary to size the downhole submersible pump with the production capacity of the payzone. In particular, in the production of oil from a shallow borehole, it is advantageous to produce the well at the maximum production rate so that the maximum drawdown is effected which causes the oil to continually migrate at a higher rate towards the production hole. This action causes a cone of depression to be formed circumferentially extending about the wellbore. It is desirable that the pump produce the payzone in this manner and yet not encounter a pump off condition, or otherwise the pump will rapidly wear and require premature replacement.

Therefore, it is advantageous to be able to produce a well for a significant length of time at a rate which eventually reaches a pump off condition, whereupon the pump is shut in for a finite time based on the production history of the well. By producing a well in this cyclic manner, the payzone is always producing the maximum amount because the well is always operating near a maximum drawdown condition.

In order to cyclically shut in a well for a predetermined time, based on the flow characteristics of the production zone, and to cyclicly produce the well until a pump off condition has been encountered, various timing means have heretofore been employed. However, this is not always acceptable because the flow characteristics of the shallow well can significantly change from time to time and this can result in the submersible pump being operated under pump off conditions for significant length of time, thereby causing irreparable damage to the pump and motor. On the other hand, if a pump off condition is not encountered during the alternate flow no-flow timed conditions, maximum draw down is not achieved and the efficiency of operation is impared.

Accordingly, it would be desirable to have made available a pump off control for a submersible pump which enables the pump to produce at a maximum rate over a long period of time without damaging the pump due to encountering a pump off condition. Method and apparatus by which this desirable goal is achieved is the subject of this disclosure.

BRIEF DESCRIPTION OF THE DRAWINGS

FIG. 1 is a part diagrammatical, part schematical plan view which discloses a cross-sectional view of part of the earth, with there being a wellbore and apparatus associated therewith made in accordance with the present invention;

FIG. 2 is a diagrammatical representation of the method of the present invention; and, FIG. 3 is a part diagrammatical, part schematical, part cross-sectional view of part of the apparatus disclosed in FIG. 1.

DETAILED DESCRIPTION OF THE PREFERRED EMBODIMENTS

Figure 3:
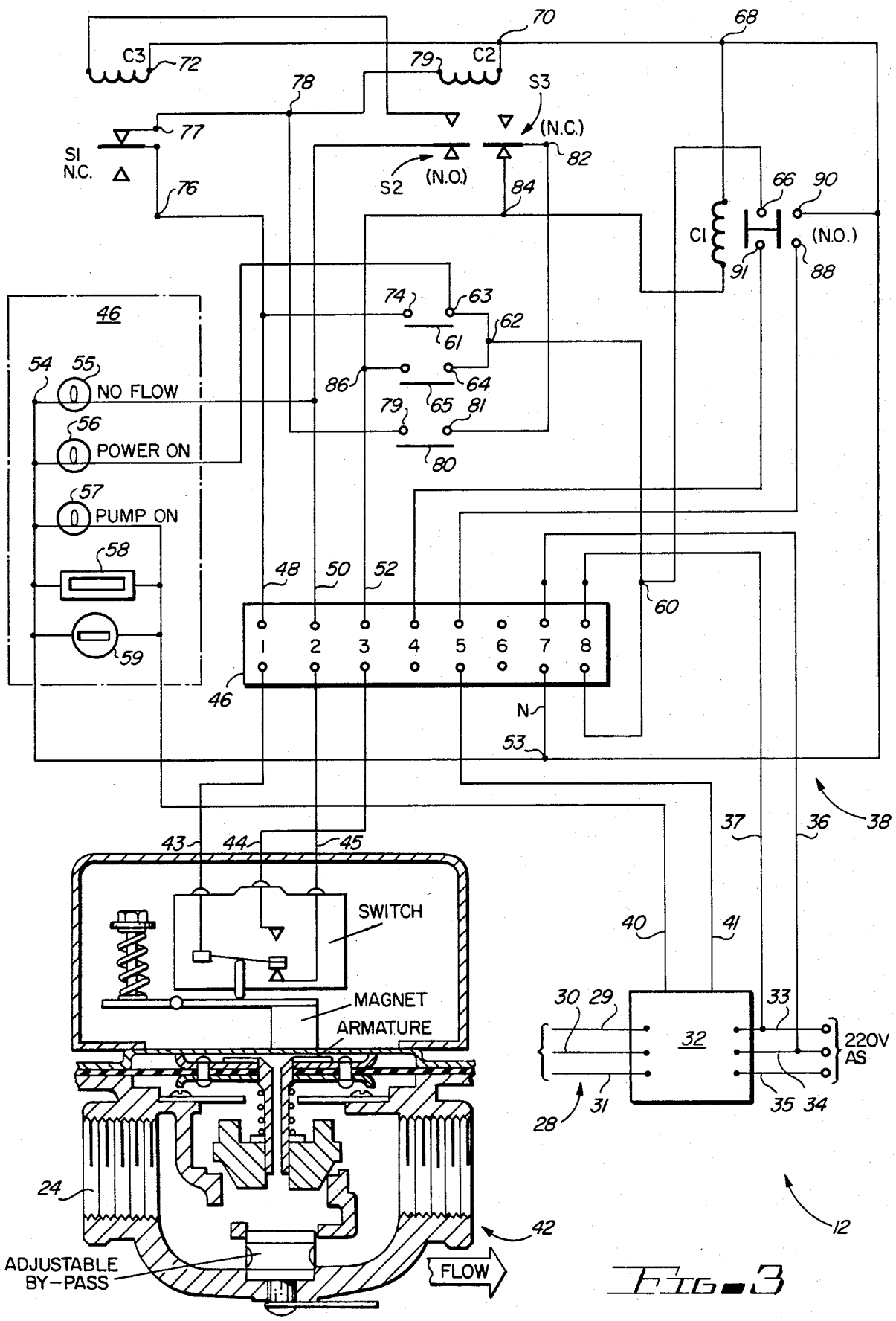

In FIG. 1 of the drawings, there is broadly indicated by the arrow at numeral 10, a submersible pump system made in accordance with the present invention. The pump system includes a pump off control 12, the details of which will be more fully disclosed later on herein, for producing fluid from a wellbore 14. The wellbore extends through an aquifer 16 and on downhole to a shallow oil payzone 18. Sometimes payzone 18 is an aquifer, or strata of water, such as seen at 16.

A submersible pump 19, having a motor 20, production end 21, and production inlet 22 is suspended downhole within a casing 23 of the borehole. A string of tubing 24 is supported from a wellhead 25 and connects the production end of the submerible pump with a gathering system. Annulus 26 is formed between the tubing string and the casing.

Liquid level 27 changes from an elevation considerably above the inlet 22 to an elevation which causes air to be ingested into the inlet 22 of the pump, which constitutes a pump off condition. The pump is electrically operated by means of electrical conductors at 28, which includes the three illustrated wires 29, 30, and 31 connected to a motor starter 32.

A source of current, usually 220 volts AC, is connected to the starter by means of electrical conductors 33, 34, and 35; with wire 34 being the neutral conductor. Electrical conductors 36 and 37 connect a pump off control 38, made in accordance with the present invention, to a 110 volt source of current. Electrical wires or conductors 40 and 41 interconnect the motor starter with the pump off control circuitry 38.

A flow switch 42 is series connected in the tubing 24 at a location downstream of the submersible pump. The flow switch preferably is a McDonnell #FS-6 flow switch; McDonnell and Miller, Inc. 3500 N. Spalding Avenue, Chicago, Ill. 60618. The flow switch is connected by wires 43, 44, and 45 into the circuitry of the pump off control 38. Panel 46 provides information related to the flow condition of the system 10.

Looking now to the details diagrammatically set forth in FIG. 2, the motor starter is seen to be connected to a source of current by a main breaker M. The source of current can be 220 or 440 volts. The starter switch of the motor starter is connected to the control circuitry 38, which includes timer number 1, timer number 2, operating relay, and operating switch. The flow switch 42 is connected into the control circuitry.

In the operation of FIGS. 1 and 2, with a suitable source of current S available, and a water level 27 above pump intake 22, the operating switch is closed, thereby energizing timer number 2 which commences timing out. The timer can be set for any desired time interval, but preferably is set for one minute. The operating switch also closes the operating relay which energizes the starting circuit of the motor starter 32, so that the production end 21 of the production pump commences to produce fluid.

The produced fluid flows through the flow switch 42, thereby moving the contacts of the flow switch from a no-flow into a flow configuration. This action provides a signal to the operating relay, which shunts the action of timer 2, and thereby continues the operation of the pump so long as there is sufficient production fluid flowing through flow switch 42 to prevent the switch from shifting back to the no-flow position.

In the above example, in the event the submersible pump instead failed to produce fluid, thereby failing to shift the flow switch to its alternate position, timer 2 is connected to cause the operating relay to cause the motor starter to interrupt current flow to the submersible pump motor, thereby shutting in the pump. This action of switch 42 occurs any time a pump off condition is encountered. Upon the motor of the submersible pump being shut in, timer 1 commences to time out. The purpose of timer 1 is to provide the downhole formation ample time in which to recuperate and fill the lower borehole with fluid. Accordingly, timer 1 is set to time out after the lapse of a time interval which is based on the history of the operating characteristics of the well. This time lapse usually is of the order of one-half hour, as for example 20 minutes. After 20 minutes has lapsed, timer 1 times out, and causes the operating relay to again close the starting contacts of the motor starter whereupon the motor starter energizes the motor of the submersible pump, and the above sequence of events takes place another time. The downhole pump continues to operate in this manner until some intervening circumstance occurs.

FIG. 3 sets forth the details of a more specific embodiment of the present invention. As seen in FIG. 3, the before mentioned conductors 43 and 45 are connected to the normally closed switches of flow switch 42, while conductor 44 is connected to the normally open switch thereof. Therefore, the flow switch is illustrated in the standby configuration, wherein the N. C. conductors 43 and 45 conduct, and when flow occurs through the flow switch, conductors 43 and 44 are connected together by the illustrated N. O. contacts, for a purpose which will be more fully explained hereinafter.

Panel 46 supports electrical terminals 1–8 thereon. Conductors 48, 50 and 52 are connected to terminals 1, 2, and 3 which in turn are connected to the before mentioned conductors 43, 44, and 45 of the flow switch 42.

Terminal 7 is connected to neutral 34 and to junction 53, thereby providing circuitry along the leg which terminates at 54 and to which there is connected a no-flow light 55, a power on light 56, a pump on light 57, a running meter 58, and a cycle counter 59. The other side of elements 55–59 are connected to be energized in a manner as will be more fully discussed later on in this disclosure.

Junction 60 is connected to terminal 8 which in turn is connected to supply 110 volts at conductor 33 of the 220 volt source. Junction 60 provides current flow along two different legs, one of which is comprised of terminal 62 connected to contact 63 of the operating switch, and which provides the power on light 56 with current, thereby illuminating lamp 56 when the circuitry is energized.

Junction 60 is also connected to contact 64 of the operating switch thereby providing current to coil C1 of the relay as well as to conductor 52. The other leg connected to junction 60 provides contact 66 of the relay with a source of current from terminal 8.

The neutral at junction 53 is also connected to junction 68 which provides a return electrical flow path for coil C1 of the relay, terminal 70 of coil 2 of timer 2, and junction 72 of coil 3 of timer 1, thereby providing a neutral for one side of each of the coils. Switch contact 74 of the operating switch is connected to the before mentioned conductor 48, and to junction 74 of the operating switch, thereby providing a source of current at junction 76 and terminal 1. Junction 76 is connected to the N. C. operating switch contact S1 of timer 1, so that when the contacts S1 are closed, current flows from 76 to junction 78 and to terminal 79 of coil C2 of timer 2.

The operating switch includes operating contact 80 which provides circuitry from junction 78, through 80, to the junction 82 of the N.C. operating switch contact S3 of timer 2. The switch contact S3 connects junctions 82 and 84 so that current is available at coil C1 of the relay and junction 86 which is connected to terminal 3.

The relay includes individual pairs of N.O. switch contacts 88, 90, and 66, 91 which are closed when the relay coil C1 is energized.

The operating switch has the illustrated contacts 63, 74 which are N.O. and are closed by member 61; contacts 64, 86 which are N.O. respective to member 65; and contacts 79, 81 which are N. O. and are closed by member 80.

Timer 1 has a coil C3 which opens the N.C. contacts S1 thereof after a specified time delay. Timer 2 has a coil C2 which operates the contacts S2 from the normally open to the normally closed position after a predetermined time interval; and, the normally closed contacts S3 from the N. C. to open position after a predetermined time interval.

In operation, when it is desired to commence the pumping action, with the pump control of the present invention monitoring and controlling the operation of the system, the operating switch is moved to the automatic position, thereby closing contacts 63, 74, and 79, 81, respectfully, by members 61 and 80, respectfully. This action energizes junctions 76, 77, 78 and terminal 79, thereby energizing coil C2 of timer 2. At the same time, current flows from junction 78, across terminal 79, 81, to contact 82 of switch S3, and to junction 84 near coil C1, thereby providing a current source for the delay, and closing the relay contacts.

Energization of junction 76 also energizes terminal 1, thereby providing current flow at 43, 45, terminal 2, and lights no-flow lamp 55.

Simultaneously with the above events, current flows from junction 84 to the coil C1 of the relay. The relay is energized, thereby closing the pairs of contacts 88 and 90; 66 and 91. This energizes the pump starter panel 32 causing the motor of the pump to start and production ordinarily should very soon occur through the flow line at this time. As production occurs, the flow switch 42 shifts to the alternate position.

Simultaneously, timer 2 starts timing out. If no flow occurs in order to open the circuit between 48 and 50; and close the circuit between 48 and 52 prior to timer 2 timing out, the circuitry will cause the pump to be shut down. Assuming that the flow switch 42 is moved to the alternate position, contact between terminals 1 and 3 will be established while contact between terminals 1 and 2 will be open. This action will continue to energize coil C1 of the relay and thereby continue to hold the relay in the operative configuration. However, coil C1 now is connected at 84, 3, 1, 74, 63, 62, 60, and 8. As long as terminals 1 and 3 of the flow switch are connected or bridged by the flow switch, the relay will remain energized and the pump will continue operation.

However, should the flow diminish sufficiently to open the contacts between terminals 1 and 3, that is, the illustrated armature and magnet of the flow switch are moved, which causes the switch assembly thereof to assume the alternate or no-flow or pump off configuration, this action causes contact between terminals 1 and 3 to be opened, while contact between terminals 1 and 2 is again established. This action again energizes timer 2 which commences its time period running. Should the timer 2 time out, the pump is shut in until timer 1 times out in order to enable the downhole reservoir to replenish itself.

Contact 80 prevents coil C2 of timer 2 from being energized when the switch is placed in the manual operation position. Without the presence of this contact of the switch assembly, coil C2 would alternately heat up and time out again and again, which is undesirable.

The timers T1 and T2, respectfully, are the model 7022 and 7012 series, respectfully, available from Control Products Division, 2330 Vauxhall Road, Union, N.J. 70783. Switch S1 is normally closed and is moved to the open position when coil C3 is energized for a time period. Switch S2 is normally open and is moved to the closed position when coil C2 is energized for a time period. Switch S3 is normally closed and is moved to the open position when coil C2 is energized for a time period. Switch pairs 66, 91, and 88, 90 are normally open and are moved to the closed position immediately upon energization of coil C1.

Switch breakers 61 and 80 are normally open and are concurrently moved to the closed position when the switch is placed in automatic; and, switch 65 is moved into the closed position when it is desired to manually operate the pump motor. The flow switch 42 is shown in the stand by or "on the shelf" condition. The switch is therefore illustrated in the no-flow configuration.

When the power source is turned on and the circuitry is in the stand by configuration, the operating switch is placed in the automatic position which moves 61 and 80 into the closed position and 65 remains in the open position. Current flow from 8, 62, 63, 74, junction 76, normally closed S1, 77, 78, and 79 thereby energizing C2 of T2. T2 commences timing out, and if set for one minute, will de-energize C1, thus shutting in the well, while energizing C3 which determines the shut in period.

At the same time, current flows from 78, 79, 80, 81, 82, S3 normally closed, 84 to relay C1. This energizes the pump motor.

At the same time current flows at 48, junction 1, through the closed switch of 42, back through junction 2 and lights no-flow light 55. Moreover, 42 is in the no-flow configuration and must move to the alternate position within one minute to avoid shut down. Assuming that no-flow occurs, T2 times out, moving S2 to the closed position and S3 to the open position. Movement of S3 to the open position releases the relay because C1 is de-energized, noting that 82, 84 is broken, while 65 is open, and 44 is open.

Closure of S2 of T2 commences C3 timing out. During this time S1 normally closed remains closed, which continues to energize C2 so that the relationship of S2 and S3 continues to be in the shut down configuration. After the set time interval expires, C3 times out, opening S1 normally closed, whereupon C2 is de-energized, thereby returning S2 to the normally open position and S3 to the normally closed position so that the operation of the circuitry starts all over again.

On the other hand, when production occurs, the flow switch 52 shifts to the flow configuration, thereby connecting 43, 44 together and providing current flow from 60, along the path to 62, 63, 74, 48, terminal 1, 43, 44, and back to terminal 3, 52, 86 and directly on to coil C1. Therefore, so long as 43, 44 are conducting, there will be current available at junction at 84, which is directly connected to C1 and holds the relay closed so that the neutral 7 and the hot wire 8 are connected at 40, 41 to the motor starter circuitry 32. Hence, the motor will continue to run until a pump off condition is reached, or the operating switch is manually opened.

I claim:

1. In a submersible pump assembly of the type having a motor and pump connected together so that when the pump inlet is positioned below the liquid level of a borehole, a motor controller energizes the pump motor which drives the pump to force production fluid from the pump to flow to the surface of the ground, the combination with said pump motor and pump of a pump-off controller;

said pump-off controller includes flow responsive switch means, a first time delay relay, a second time delay relay, an operating switch, and a running relay;

circuit means connecting said operating switch to said second time delay relay to provide a starting circuit which is connected to cause said running relay to close and thereby connect said motor controller to start said pump motor and to continue to run said pump motor until said second time delay relay times out;

said flow responsive switch means is actuated from a no-flow to a flow position when said pump produces a suitable flow of fluid, circuit means connected to hold said running relay in the operating position so long as said flow responsive switch means is in the flow position; thereby obviating the action of said second time delay relay;

circuit means by which said first time delay relay is energized when the flow responsive switch means assumes the no-flow position and the second time delay relay has timed out.

2. The combination of claim 1 wherein said running relay includes an actuator coil, said first time delay is a normally closed switch connected in series with the coil of said relay, and means connected to open said normally closed switch when said flow responsive switch means remains in the no-flow position beyond a preset time interval.

3. The combination of claim 1 wherein said second time delay has a normally open and a normally closed switch actuated by a timing element, said normally open switch is connected to actuate said first time delay relay and said normally closed switch is connected to actuate said running relay.

4. The combination of claim 1 wherein said flow switch has a normally closed and a normally open switch, the normally open switch is connected to maintain a coil of said running relay energized when the flow switch is in the flow condition; and, the normally closed switch is connected to said second time delay relay.

5. The combination of claim 4 wherein said first time delay includes a normally closed switch connected in series with the coil of said relay;

said second time delay has a normally open and a normally closed switch actuated by a timing element, said normally open switch is connected to energize said first time delay and said normally closed switch is connected to actuate said running relay.

6. In a pump assembly having an electric motor which drives a production pump for causing liquid to flow, a pump off control by which the electric motor is de-energized when a pump off condition is encountered, the improvement comprising:

a flow switch means having a normally open and normally closed switch means;

a first timer set for a relatively long time, a second timer set for a relatively short time, an operating switch, a relay by which a source of current is connected to a motor starter;

means connecting said motor starter for providing a source of current to the electric motor;

circuit means by which said operating switch conducts current flow to a normally closed switch of the first timer and from the normally closed switch to the timing element of the second timer thereby starting the second timer running; said circuit also connects a source of current through the normally closed switch of the flow switch means to the normally open switch of the second timer; said normally closed switch of the first timer also connects the normally closed switch of the second timer to the coil of said relay thereby moving the relay into an alternate position and supplying current to start the motor and causing liquid to flow through said flow switch means;

whereby; when the flow switch means assumes an alternate configuration, the normally closed switch thereof is moved to the open position while the normally open switch thereof is moved to the closed position, and thereby provides a direct current flow to the operating coil of the relay.

7. The improvement of claim 6 wherein said first timer is a normally closed switch connected in series with the coil of said relay, and means connected to open said normally closed switch when said switch means flow remains in the no-flow position beyond a preset time interval.

8. The improvement of claim 7 wherein said second timer has a normally open and a normally closed switch actuated by a timing element, said normally open switch is connected to actuate said first timer relay and said normally closed switch is connected to actuate said relay.

9. The improvement of claim 8 wherein said flow switch means has a normally closed and a normally open switch, the normally open switch is connected to maintain a coil of said relay energized when the flow switch is in the flow condition; and, the normally closed switch is connected to said second timer.

10. The improvement of claim 6 wherein said first timer includes a normally closed switch connected in series with the coil of said relay;

said second timer has a normally open and a normally closed switch actuated by a timing element, said normally open switch is connected to energize said first timer and said normally closed switch is connected to actuate said relay.

* * * * *

UNITED STATES PATENT AND TRADEMARK OFFICE

CERTIFICATE OF CORRECTION

PATENT NO. : 4,507,053

DATED : March 26, 1985

INVENTOR(S) : MARVIN L. FRIZZELL

It is certified that error appears in the above-identified patent and that said Letters Patent is hereby corrected as shown below:

Column 8, line 8, insert --flow-- before "switch";
Line 9, delete "flow" before remains;
Line 14, delete "relay" after timer;
Line 21, insert --means-- after "switch".

Signed and Sealed this

*Twentieth* Day of *August 1985*

[SEAL]

*Attest:*

DONALD J. QUIGG

*Attesting Officer* *Acting Commissioner of Patents and Trademarks*